US006782625B1

(12) United States Patent
Wong

(10) Patent No.: US 6,782,625 B1
(45) Date of Patent: Aug. 31, 2004

(54) ENCASED ELECTRIC SHAVER

(75) Inventor: John Ying Man Wong, New Territories (HK)

(73) Assignee: Raymond Electric (China) Ltd., Shatin (HK)

( * ) Notice: Subject to any disclaimer, the term of this patent is extended or adjusted under 35 U.S.C. 154(b) by 0 days.

(21) Appl. No.: 10/175,097

(22) Filed: Jun. 20, 2002

(51) Int. Cl.[7] ..... B26B 19/02
(52) U.S. Cl. ..... 30/43.92; 30/34.05
(58) Field of Search ..... 30/43.92, 34.05, 30/47

(56) References Cited

U.S. PATENT DOCUMENTS 2,691,216 A * 10/1954 Ross ..... 30/34.05
2,787,830 A * 4/1957 Argiro ..... 30/34.05
2,803,874 A * 8/1957 Obolensky ..... 30/43.4
2,838,835 A * 6/1958 Jepson ..... 30/34.05
3,386,168 A * 6/1968 Loner ..... 30/43.92
3,538,604 A * 11/1970 Walter et al. ..... 30/34.05
3,552,006 A * 1/1971 Baumann et al. ..... 30/34.1
3,562,905 A * 2/1971 Rakocy et al. ..... 30/34.05
3,793,724 A * 2/1974 Messinger et al. ..... 30/41
4,751,781 A * 6/1988 Szymansky et al. ..... 30/537
4,969,266 A * 11/1990 Poganitsch ..... 30/34.05
5,193,275 A * 3/1993 Hirokazu et al. ..... 30/43
6,000,135 A * 12/1999 Ullmann et al. ..... 30/43.92

* cited by examiner

*Primary Examiner*—Allan N. Shoap
*Assistant Examiner*—Isaac Hamilton
(74) *Attorney, Agent, or Firm*—Leydig, Voit & Mayer, Ltd.

(57) ABSTRACT

An electric shaver has a casing and a shaving mechanism housed within the casing. The shaving mechanism includes a shaving head. The shaving mechanism is movable from a storage position to a use position where the shaving head protrudes from the casing. A switch operates upon movement of the shaving mechanism to activate the shaving mechanism.

28 Claims, 7 Drawing Sheets

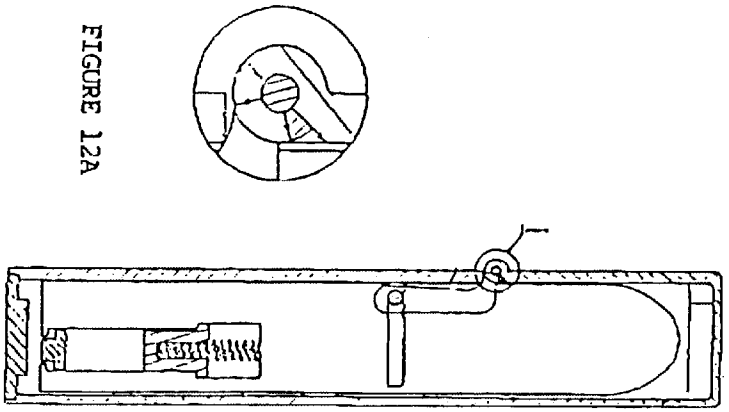
FIGURE 12A
FIGURE 12
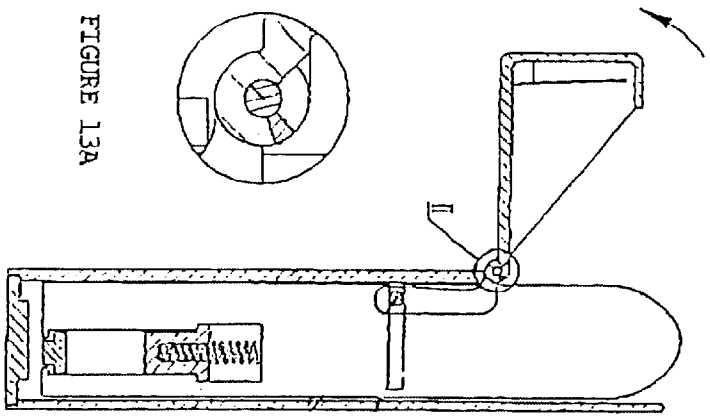
FIGURE 13A
FIGURE 13

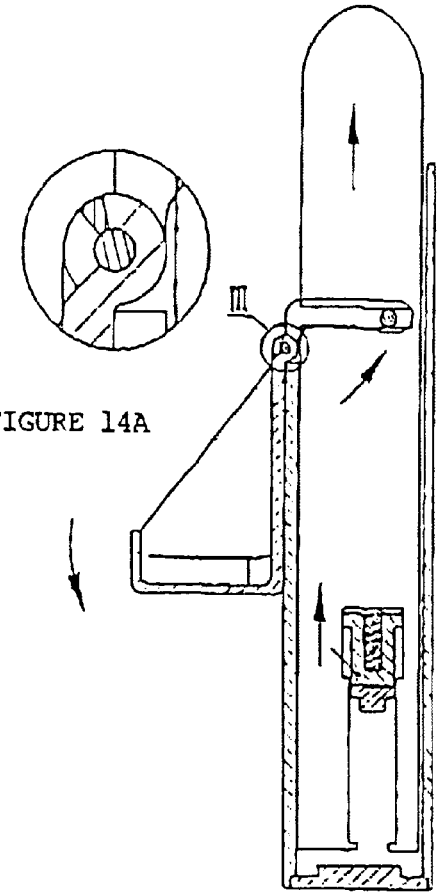
FIGURE 14A
FIGURE 14
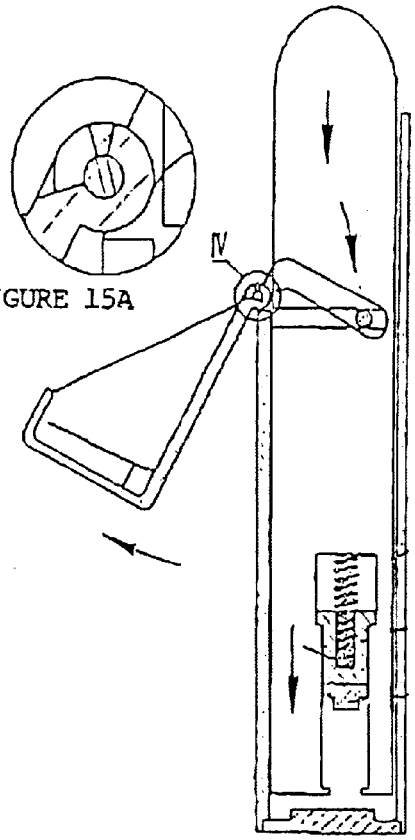
FIGURE 15A
FIGURE 15

ENCASED ELECTRIC SHAVER

BACKGROUND OF THE INVENTION

The present invention relates to electric shavers. More particularly, though not exclusively, the invention relates to an encased, battery-operated shaver suitable for carrying from place-to-place.

Known electric shavers, be they battery-operated or mains powered are not generally suitable for day-to-day, on-the-go use. Mains powered shavers are limited to use nearby a wall socket, whereas "cordless" shavers are larger and more cumbersome than would be ideal for general in-pocket carrying. Such shavers often include a perforated metallic screen or foil that must be covered for protection when the shaver is rot in use. Known clip-on covers must be removed completely from the body of the shaver and therefore must be held or placed somewhere during use and then reattached to the shaver body. Such covers are generally a design afterthought and are not well integrated with the shaver body. They are generally too clumsy and cumbersome for on-the-go electric shavers.

OBJECTS OF THE INVENTION

It is an object of the present invention to overcome or substantially ameliorate at least one of the above disadvantages and/or more generally to provide an encased electric shaver for use on-the-go.

It is a further object of the present invention to provide an electric shaver having a shaving head housed within a casing and a lid attached pivotally to the casing to conceal the shaving head when not in use.

It is a further object of the present invention to provide an encased electric shaver having a lid associated with a switch by which the shaver is activated.

It is still a further object of the present invention to provide an electric shaver having a casing within which a shaving head is concealed by a lid when not in use and wherein the shaving head is moved from a storage position to a use position upon movement of the lid.

DISCLOSURE OF THE INVENTION

There is disclosed herein an electric shaver comprising:

a casing, a shaving mechanism housed within the casing, a lid attached to the casing, and a switch operated by movement of the lid to activate the mechanism.

Preferably the switch is operated upon movement of the shaving mechanism by the lid.

There is further disclosed herein an electric shaver comprising:

a casing, a shaving mechanism housed within the casing and including a shaving head, the shaving mechanism being movable from a storage position to a use position wherein the shaving head protrudes from the casing, and a switch operated by movement of the shaving mechanism to activate the mechanism.

Preferably the shaver further includes a lid that interacts with the shaving mechanism to move the shaving mechanism between the storage and use positions.

Preferably a hinge attaches the lid to the casing.

Preferably in some positions of the lid, a spring biases the lid to a closed position.

Preferably in other positions of the lid, the spring biases the lid to an intermediate position.

Preferably the spring is mounted within a spring tube that is mounted pivotally at a pivot end thereof go the casing.

Preferably the lid has a finger extending from it and engaging with the spring tube at a contact end thereof remote from the pivot end.

Preferably the spring tube is constrained within a pivot-limiting space.

Preferably the pivot-limiting space has two abutment surfaces against which the spring tube can bear.

Preferably approximately midway between the abutment surfaces, there is an imaginary line past which the spring tube pivots by movement of the lid so as to bias the lid toward one or the other of said closed position and said intermediate position.

Preferably a shaving mechanism-positioning spring biases the shaving mechanism toward the storage position when the lid has moved past said intermediate position and the switch is closed.

Preferably the shaving mechanisms-positioning spring biases the shaving mechanism toward a switch-open position.

Preferably the shaving mechanism-positioning spring is received within a cup against which a leg extending from the shaving mechanism bears.

Preferably the cup is mounted within a cup slot of the casing.

Preferably there is attached to the lid an arm, that extends into the casing and includes a pin that cooperates with a pin slot of the shaving mechanism to move the shaving mechanism.

Preferably the arm is attached pivotally to the lid by a special hinge having a free space within which an arm catch of the arm is received, the lid being pivotable throughout a range defined by the free space before engaging with the arm catch to cause pivotal movement of the arm.

BRIEF DESCRIPTION OF THE DRAWINGS

A preferred form of the present invention will now be described by way of example with reference to the accompanying drawings, wherein:

FIGS. 12 to 15 are further schematic cross-sectional side elevational views of the shaver casing showing the lid at different orientations, with FIGS. 12A to 15A showing hinge detail corresponding to FIGS. 12 to 15, respectively.

DESCRIPTION OF THE PREFERRED EMBODIMENT

Figure 1:
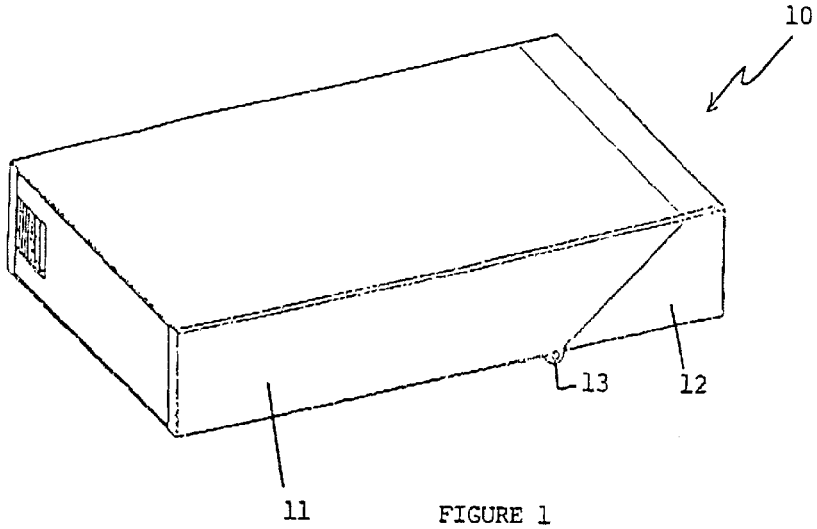
FIG. 1 is a schematic perspective illustration of an electric shaver casing.
Figure 2:
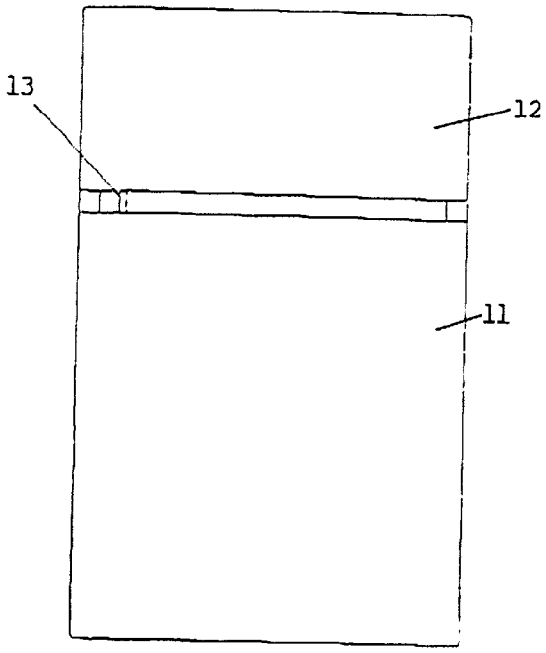
FIG. 2 is a schematic front elevational view of the shaver casing of FIG. 1.
Figure 3:
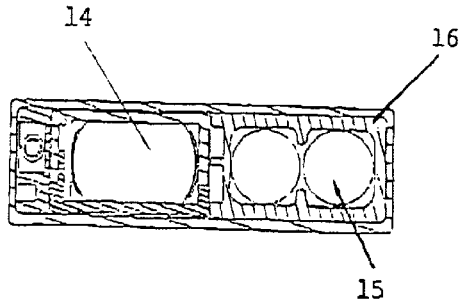
FIG. 3 is a schematic cross-sectional illustration of the shaver casing of FIGS. 1 and 2.

In the accompanying drawings there is schematically depicted an encased electric shaver 10. Shaver 10 includes a casing 11 having a lid 12 attached hingedly thereto at 13 The casing and lid somewhat resemble a cigarette packet. They would be typically fabricated from steel, stainless steel, brass, silver, gold, timber, plastics or any other appealing material.

Within the casing 11 there is situated a shaving mechanism which in many respects is standard. The shaving mechanism includes an electric motor 14 powered by batteries 15 within a battery housing 16.

Figure 4:
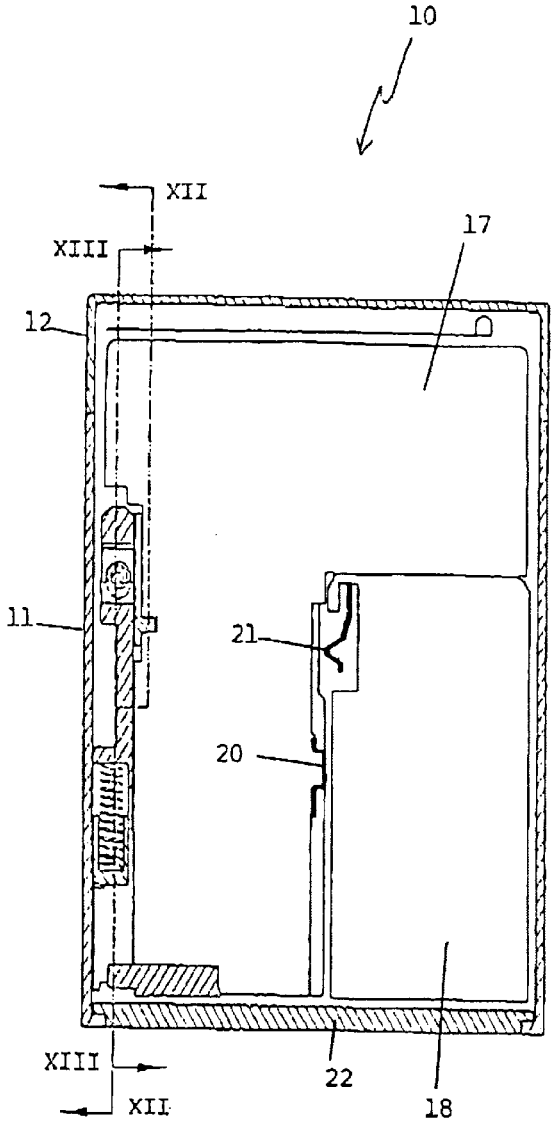
FIG. 4 is a schematic cross-sectional elevational view of the shaver casing, taken at IV—IV in FIG. 8.
Figure 5:
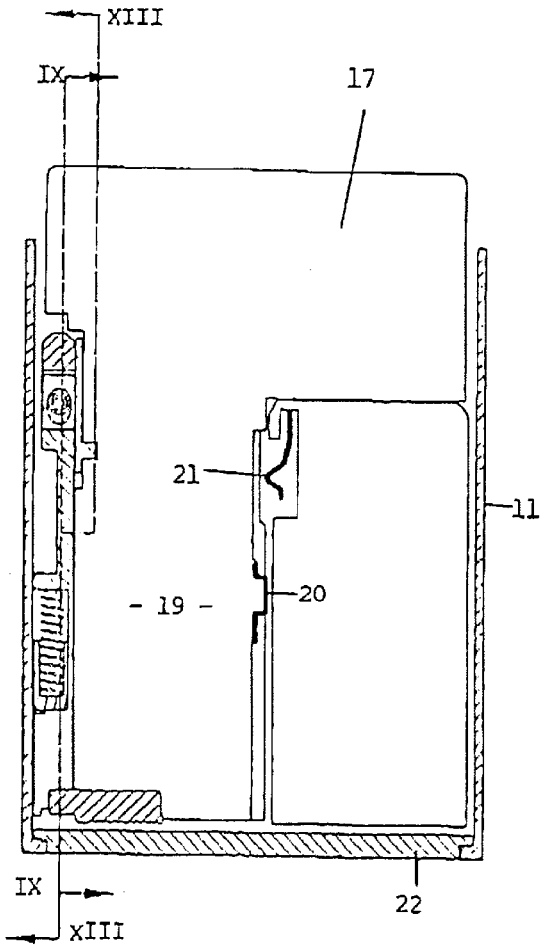
FIG. 5 is a schematic cross-sectional elevational view of the shaver casing taken at V—V in FIG. 9.

As shown in FIG. 4, the casing 11 includes a base cover plate 22 which retains batteries 18 in place. The base cover plate 22 might include a locking device or slide tab to enable removal of the base cover plate for replacement of the batteries.

The shaving mechanism also includes a shaving head 17 having a perforated foil cover 17A beneath which shaving plates or blades (not shown) are situated. Such blades or plates would be mounted to a common block that is driven by the electric motor 19 to vibrate against the inner surface of the foil 17A to cause severing of whispers passing through the foil perforations.

The shaving mechanism which includes the shaving head 17 is mounted so as to move within the casing 11 so that the shaving head 17 can move to protrude from the casing when the lid 12 is opened.

Figure 6:
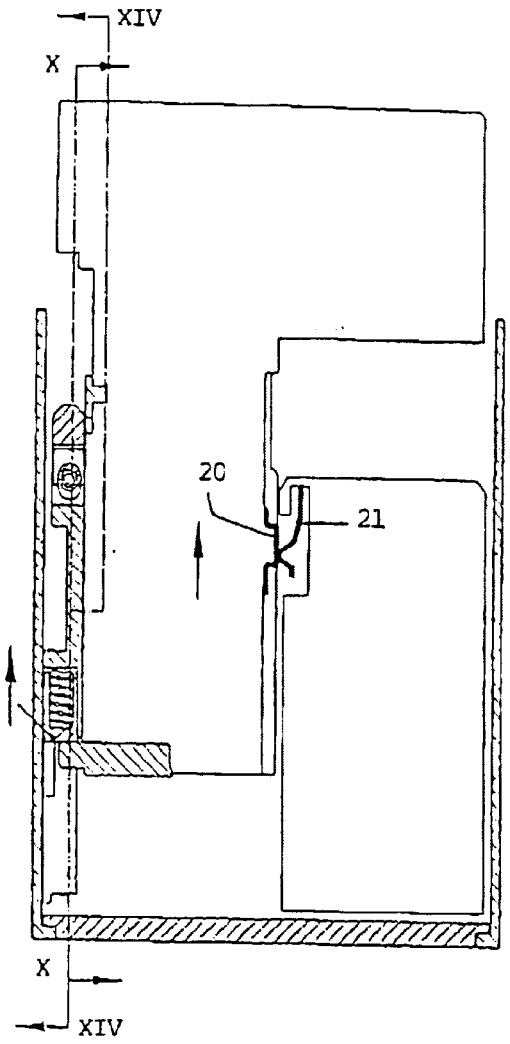
FIG. 6 is a schematic cross-sectional elevational view of the shaver casing taken at VI—VI in FIG. 10.
Figure 7:
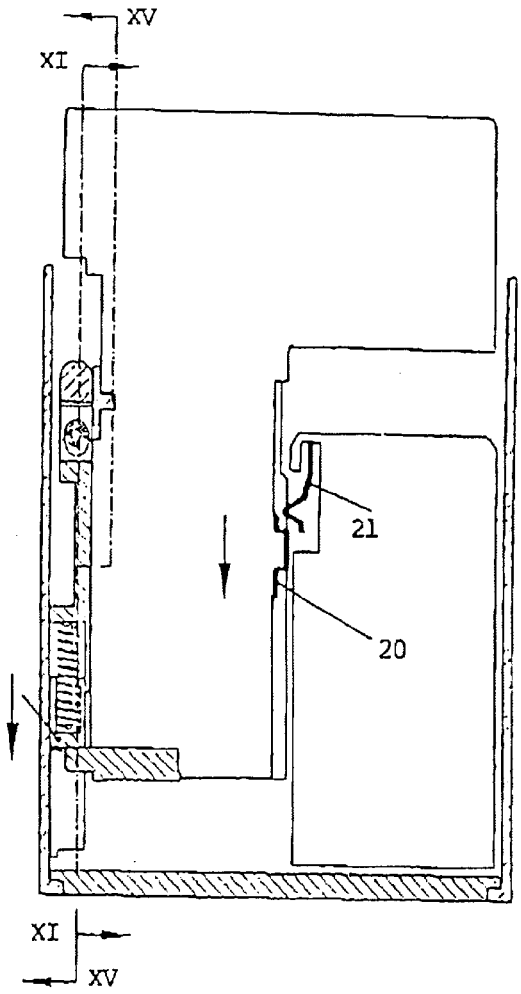
FIG. 7 is a schematic cross-sectional elevational view of the shaver casing taken at VII—VII in FIG. 11, FIGS. 8 to 13 are schematic cross-sectional side elevational views of the shaver casing showing movement of the casing lid at different positions.
Figure 8:
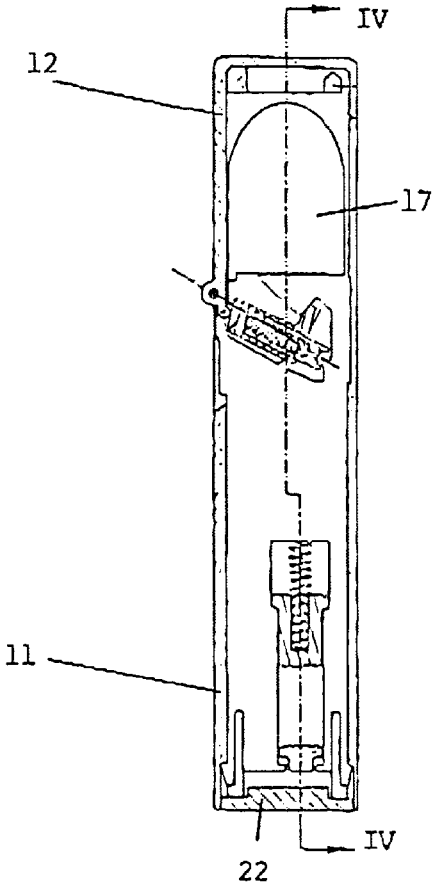

An electric switch includes a moving contact 20 and a fixed contact 21. Contact 21 is fixed in position with respect to the casing 11. Moving contact 20 moves up and down with the shaving mechanism, such that when the shaving mechanism is moved upwardly such that the shaving head 17 protrudes from the case 11, it comes into contact with the fixed contact 21. This closes an electric circuit thereby transmitting power from the batteries 18 to the motor 19 to activate the shaver. This movement is depicted in sequence steps in FIGS. 4 to 7. Also in these figures and FIGS. 8 to 11 there is depicted a positioning spring 30 located within a cup 31. Cup 31 is received within a slot 33 that is fixed with respect to the shaver casing. Extending into the slot 33 from the shaving mechanism is a leg 32. Leg 32 moves vertically within the slot 23 until it abuts the lower surface of the cup 31. At this point, the cup 31 moves upwardly so as to compress spring 30. Spring 30 compresses coincidentally with electrical contact being made between contacts 20 and 21 as shown in FIG. 6. This provides a bias to the shaving mechanism during the time that electrical contact is in place, which bias would cause the electrical contact to be broken, should there be no external forces applied. During use, such external forces are those of a user manipulating the lid 12, that in turn causes movement of the shaving mechanism and shaving head 17 in a manner to be described below.

Figure 9:
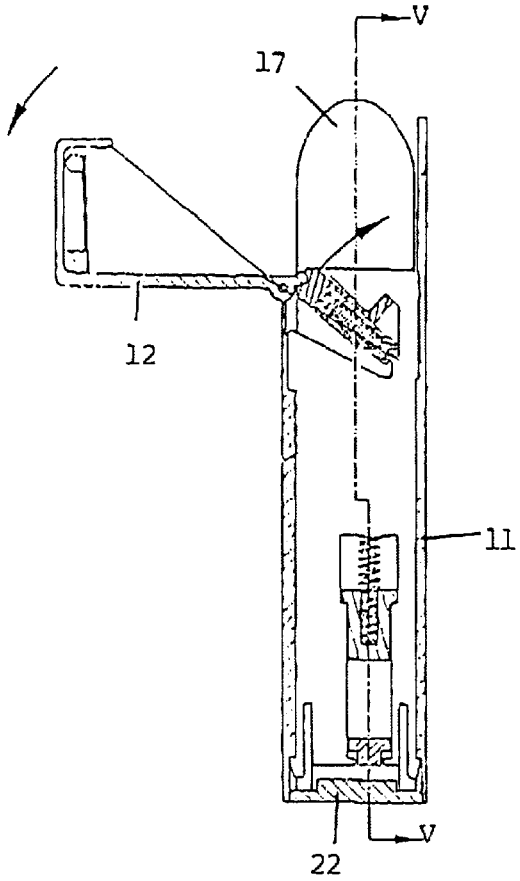
Figure 10:
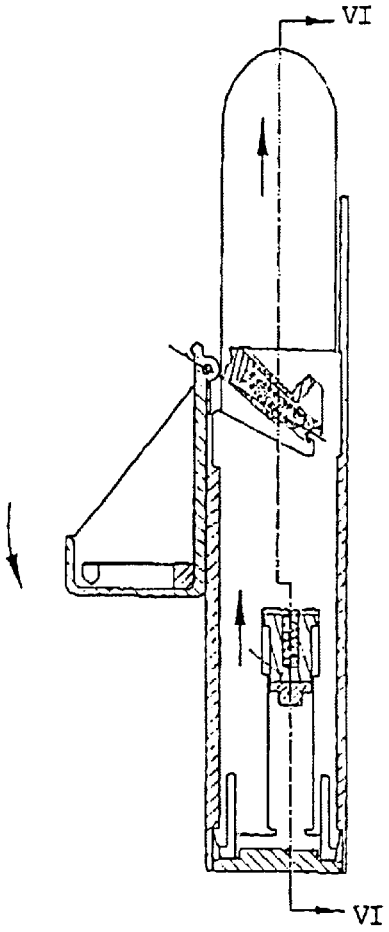
Figure 11:
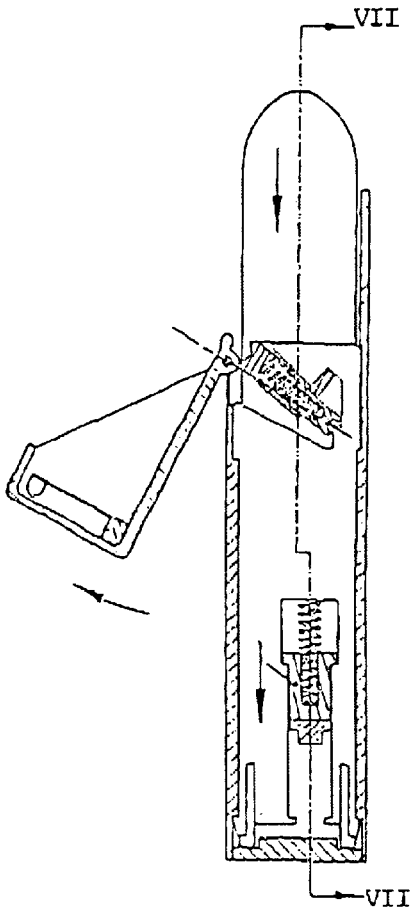

Also mounted within the casing 11 and as shown in FIGS. 8 to 11 is a spring-weighting device to give "feel" to the lid 12. This spring-weighting device comprises a spring 23A situated within a spring tube 23. Spring tube 23 is pivotally connected to the casing 11 at pivot pin 26. The spring tube 23 is received within a pivotlimiting space 25 having a lower abutment surface 28 and an upper abutment surface 29, each defining a limit to the pivotable movement of the spring tube 23. Co-operating with the end of spring tube 23 opposite the pivot pin 26 is a finger 24 that extends from the lid 12. Upon pivotal movement of the lid 12 about hinge 13, the finger 24 causes pivotal movement of the spring tube 23 about pivot pin 26. During this pivotal movement, the spring 23A compresses as it moves past an imaginary line 27 (see FIG. 8). Moreover, the spring 23A is maximally compressed at a midpoint of travel of spring tube 23 between abutment surfaces 28 and 29. This, in effect, spring-loads the lid 12 to the closed position depicted in FIG. 8 or to the 90 degree open or "intermediate" position as depicted in FIG. 9, depending upon which side of the imaginary line 27, the spring tube 23 is at.

As the spring tube 23 passes the imaginary line 27, the lid 12 crosses a threshold, or force-point.

As shown in FIGS. 12 to 15, the device also includes an internal arm 34. Arm 34 is attached to the hinge 13 in a special manner so as to commence pivoting only when the lid 12 has moved beyond the 90 degree intermediate position as depicted in FIG. 13. To this end, and as depicted in inset FIGS. 12A to 15A, the arm includes an arm catch 38 received within a free space 39 of the hinge structure. Therefore, during opening of the lid 12, the arm 34 only commences its pivotal movement when contact is made between the arm catch 38 and an end of the free space 39 as shown in FIG. 13A. During closing of the lid 12, the arm 34 only commences movement when the arm catch 38 comes into contact with the other end of the free space 39. The arm 34 is L-shaped so as to enable it to reside snugly against the inside surface of the casing 11 as shown in FIGS. 12 and 13.

The other end of the arm 34 has a pin 36 that fits within a horizontal pin slot 35 of the shaving mechanism. When the arm 34 pivots outwardly as shown in FIGS. 15 and 14, the pin 36 engages with he slot 35 to cause vertical movement of the shaving mechanism for use.

In use, one simply opens the lid 12 by moving it against initial resistance provided by the spring 23A. Continued movement of the lid causes it to pass the "threshold" point as described above, whereupon the force of the spring 23A causes the lid to "flip" to the intermediate position depicted in FIG. 9. At this stage, the shaving mechanism including the shaving head 17 remains put in its storage position. Further downward movement of the lid as shown in FIGS. 10, 11, 14 and 15 causes movement of the parts as described above to thereby raise the shaving head to its use position and close the electrical circuit to activate the motor. To maintain this electrical contact, the lid 12 must be held in the position depicted in FIG. 14, as otherwise, the spring 30 will push the shaving mechanism downwardly to open he electrical circuit that was closed by electrical contacts 20 and 21. When this force is released, the lid 12 will return to the position depicted in FIG. 11, whereupon it can be pushed manually past the threshold position to then snap closed by action of the force of spring 23A Within the lid 12, there might be provided a gong 40 on a resilient leaf as depicted to provide a pleasant "ring" when the lid 12 is snapped open or closed.

It should be appreciated that modifications and alterations obvious to those skilled in the art are not to be considered as beyond the scope of the present invention. For example, the specific switching and biasing arrangements depicted in the drawings may be substituted with equivalent devices.

What is claimed is:

1. An electric shaver comprising:

a casing, a shaving mechanism housed within the casing and movable between storage and use positions;

a lid attached to the casing and interacting with the shaving mechanism to move the shaving mechanism between storage and use positions;

a hinge attaching the lid to the casing; and a switch operated by movement of the shaving mechanism to activate the shaving mechanism.

2. The shaver of claim 1, including a spring biasing, in some positions of the lid, the lid toward a closed position.

3. The shaver of claim 2, wherein in some positions of the lid, the spring biases the lid to an intermediate position between the closed position and an open position.

4. The shaver of claim 3, including a spring tube in which the spring is mounted, the spring tube being mounted pivotally at a pivot end to the casing.

5. The shaver of claim 4, wherein the lid has a finger extending from the lid and engaging the spring tube at a contact end, remote from the pivot end.

6. The shaver of claim 4, wherein the spring tube is constrained within a pivot-limiting space.

7. The shaver of claim 6, wherein the pivot-limiting space has two abutment surfaces against which the spring tube can bear.

8. The shaver of claim 7, wherein, approximately midway between the abutment surfaces, there is an imaginary line past which the spring tube pivots by movement of the lid to bias the lid toward one of the closed position and the intermediate position.

9. The shaver of claim 8, a shaving mechanism-positioning spring biasing the shaving mechanism toward the storage position when the lid has moved past the intermediate position and the switch is open.

10. The shaver of claim 9, wherein the shaving mechanism positioning spring biases the shaving mechanism toward a switch-open position.

11. The shaver of claim 9, including a cup, the shaving mechanism-positioning spring is received within the cup, and against which a leg extending from the shaving mechanism bears.

12. The shaver of claim 11, wherein the cup is mounted within a cup slot of the casing.

13. The shaver of claim 1, including an arm attached to the lid, the arm extending into the casing and including a pin that co-operates with a pin slot of the shaving mechanism to move the shaving mechanism.

14. The shaver of claim 13, including a special hinge pivotally attaching the arm to the lid, the special hinge having a free space within which an arm catch of the arm is received, the lid being pivotable throughout a range defined by the free space before engaging the arm catch to cause pivotal movement of the arm.

15. An electric shaver comprising:

a casing, a shaving mechanism housed within the casing and including a shaving head, the shaving mechanism being movable from a storage position to a use position in which the shaving head protrudes from the casing;

a lid attached to the casing and interacting with the shaving mechanism to move the shaving mechanism between the storage and use positions, a hinge attaching the lid to the casing; and a switch operated by movement of the shaving mechanism to activate the shaving mechanism.

16. The shaver of claim 15, including a spring biasing, in some positions of the lid, the lid toward a closed position.

17. The shaver of claim 16, wherein, in some positions of the lid, the spring biases the lid to an intermediate position between the closed position and an open position.

18. The shaver of claim 17, including a spring tube in which the spring is mounted the spring tube being mounted pivotally at a pivot end to the casing.

19. The shaver of claim 18, wherein, the lid has a finger extending from the lid and engaging the spring tube at a contact end, remote from the pivot end.

20. The shaver of claim 18, the wherein the spring tube is constrained within a pivot-limiting space.

21. The shaver of claim 20, wherein the pivot-limiting space has two abutment surfaces against which the spring tube can bear.

22. The shaver of claim 21, wherein approximately midway between the abutment surfaces, there is an imaginary line past which the spring tube pivots by movement of the lid to bias the lid toward one of the closed position and the intermediate position.

23. The shaver of claim 22, a shaving mechanism-positioning spring biasing the shaving mechanism toward the storage position when the lid has moved past the intermediate position and the switch is open.

24. The shaver of claim 23, wherein the shaving mechanism-positioning spring biases the shaving mechanism toward a switch-open position.

25. The shaver of claim 23, including a cup, the shaving mechanism-positioning spring is received within the cup, and against which a leg extending from the shaving mechanism bears.

26. The shaver of claim 24, wherein the cup is mounted within a cup slot of the casing.

27. The shaver of claim 15, including an arm attached to the lid, the arm extending into the casing and including a pin that co-operates with a pin slot of the shaving mechanism to move the shaving mechanism.

28. The shaver of claim 27, including a special hinge pivotally attaching the arm to the lid, the special hinge having a free space within which an arm catch of the arm is received, the lid being pivotable throughout a range defined by the free space before engaging the arm catch to cause pivotal movement of the arm.

* * * * *